US006951335B2

(12) United States Patent
Elgee et al.

(10) Patent No.: US 6,951,335 B2
(45) Date of Patent: Oct. 4, 2005

(54) RECIPROCATING LINEAR ENCODER

(75) Inventors: Steven B. Elgee, Portland, OR (US); Steve O. Rasmussen, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 508 days.

(21) Appl. No.: 10/282,574

(22) Filed: Oct. 29, 2002

(65) Prior Publication Data

US 2004/0080101 A1 Apr. 29, 2004

(51) Int. Cl.[7] ..... G65H 9/20
(52) U.S. Cl. ..... 271/264; 271/265.01; 226/32; 226/45
(58) Field of Search ..... 271/264, 265.01, 271/265.02, 265.03, 266, 3.15, 3.17, 227, 271/228; 270/30.01, 30.05; 73/1.37, 1.41, 73/490, 514.39; 226/32, 45, 139

(56) References Cited

U.S. PATENT DOCUMENTS 4,445,679 A * 5/1984 Bay ..... 271/227
5,434,602 A 7/1995 Kaburagi et al.
5,488,464 A 1/1996 Wenthe, Jr. et al.
5,897,259 A 4/1999 Ahn
6,017,114 A 1/2000 Elgee et al.
6,042,281 A 3/2000 Ohtani
6,137,974 A 10/2000 Williams et al.
6,186,498 B1 2/2001 Suzuki et al.
6,206,263 B1 3/2001 Rich et al.
6,257,692 B1 7/2001 Yokoi et al.
6,264,303 B1 7/2001 Watanabe
6,322,069 B1 11/2001 Krucinski et al.
6,641,134 B1 * 11/2003 Dobbertin et al. ..... 271/226

FOREIGN PATENT DOCUMENTS

JP 2001225511 8/2001
JP 2002225374 8/2002

OTHER PUBLICATIONS

British Search Report dated Mar. 29, 2004.

* cited by examiner

*Primary Examiner*—Donald P. Walsh
*Assistant Examiner*—Mark J. Beauchaine

(57) ABSTRACT

A reciprocating linear encoder includes a linear encoder and a sensor. The linear encoder is configured to latch, follow and release print media in a periodic motion. The sensor is responsive to movement of the linear encoder, and is configured to output a signal associated with print media movement.

28 Claims, 5 Drawing Sheets

RECIPROCATING LINEAR ENCODER

BACKGROUND

The movement of print media within a printer may require accuracy as great as 100 (ppm) parts per million; in some cases even greater accuracy may be required. This is equivalent to a margin of error of about 0.2 mils associated with a 2 inch movement of the print media.

To achieve 100 ppm accuracy, the effective radius of printer roller shafts could be tightly controlled. For example, for a typical shaft having a 0.3 inch radius, the neutral axis, i.e. the line where the rotary velocity of the shaft and the linear velocity of the print media traveling through the paper path are equal, should be within 30 micro inches (i.e. 0.3*100 ppm), a distance which is approximately 1% of the thickness of a sheet of paper. Thus, a small deviation from the desired diameter may cause a media registration error.

Increasing the diameter of the roller is a potential solution to the issue of extremely tight tolerances required of the radius of the metering roller. However, an increased diameter can result in greater inertia during operation, which results in difficulty when printing at higher speeds.

A roller with a low contact force against the print media (such as paper) could make use of a highly frictional outer surface. However, with this approach it might be more difficult to tightly control the diameter of the roller, since the diameters of highly frictional surfaces are less easily controlled.

Alternatively, using a roller with a higher contact force against the print media may result in media deformation, which induces errors in the registration process.

SUMMARY

A reciprocating linear encoder includes a linear encoder and a sensor. The linear encoder is configured to latch, follow and release print media in a periodic motion. The sensor is responsive to movement of the linear encoder, and is configured to output a signal associated with print media movement.

BRIEF DESCRIPTION OF THE DRAWINGS

The same reference numbers are used throughout the drawings to reference like features and components.

DETAILED DESCRIPTION

A reciprocating linear encoder includes a linear encoder and a sensor. The linear encoder is configured to latch, follow and release print media in a periodic motion. The sensor is responsive to movement of the linear encoder, and is configured to output a signal associated with print media movement.

Figure 1:
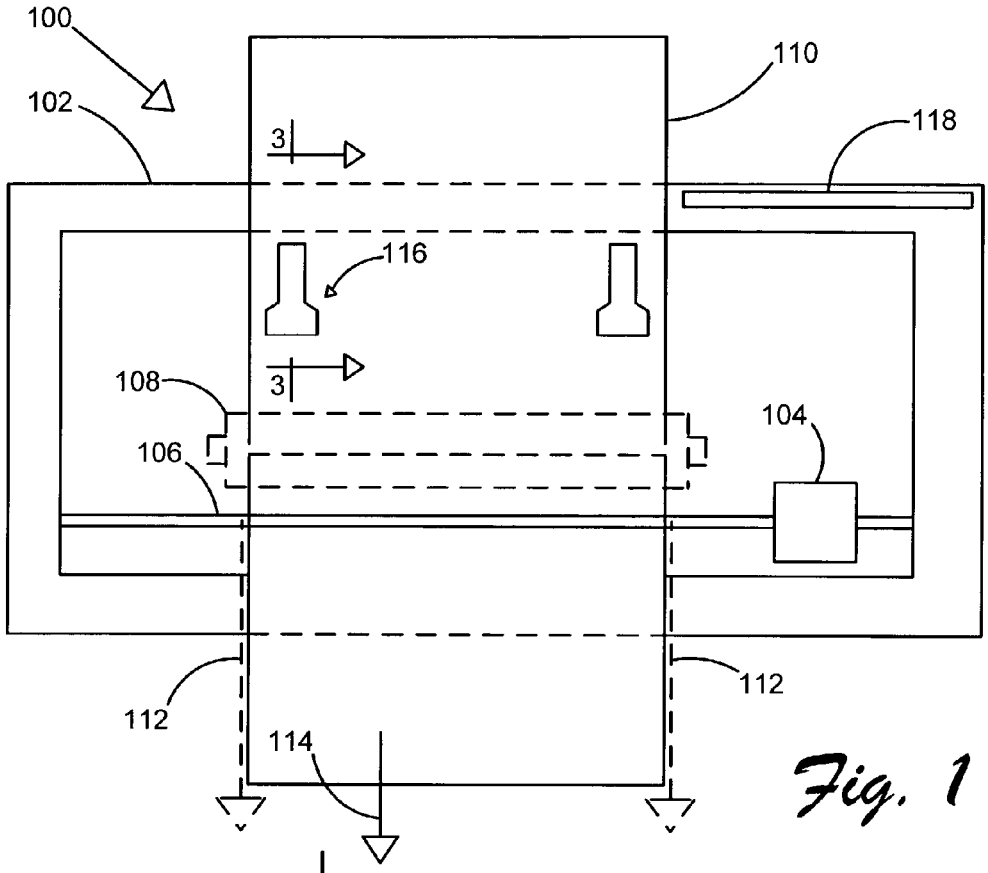
FIG. 1 is a plan view of an implementation of a reciprocating linear encoder installed in a printer.

FIG. 1 shows an exemplary implementation 100 of a reciprocating linear encoder to perform print media or linefeed registration within a printer 102 or other hardcopy output device. The printer 102 may be based on a variety of technologies, such as that found in ink jet printers. In the exemplary implementation of FIG. 1, the printer is based on ink jet technology. A printhead 104 moves along a carriage rod 106. A print media advancement mechanism 108 may be based on one or more roller sets, which drive print media 110, such as paper, envelopes or other material, through a media or paper path 112. The direction of media movement 114 indicates the direction by which print media moves during the course of printing.

Print media registration involves maintaining knowledge of the location and orientation of the print media (e.g. sheets of paper and envelopes) as the print media 110 moves through the paper path 112 in the direction of media movement 114. As will be seen in greater detail below, an exemplary print media or linefeed registration apparatus includes a reciprocating linear encoder 116, which may include a linear encoder, sensor, tensioning element, biasing element, registration decoder electronics 118 and other elements.

Figure 2:
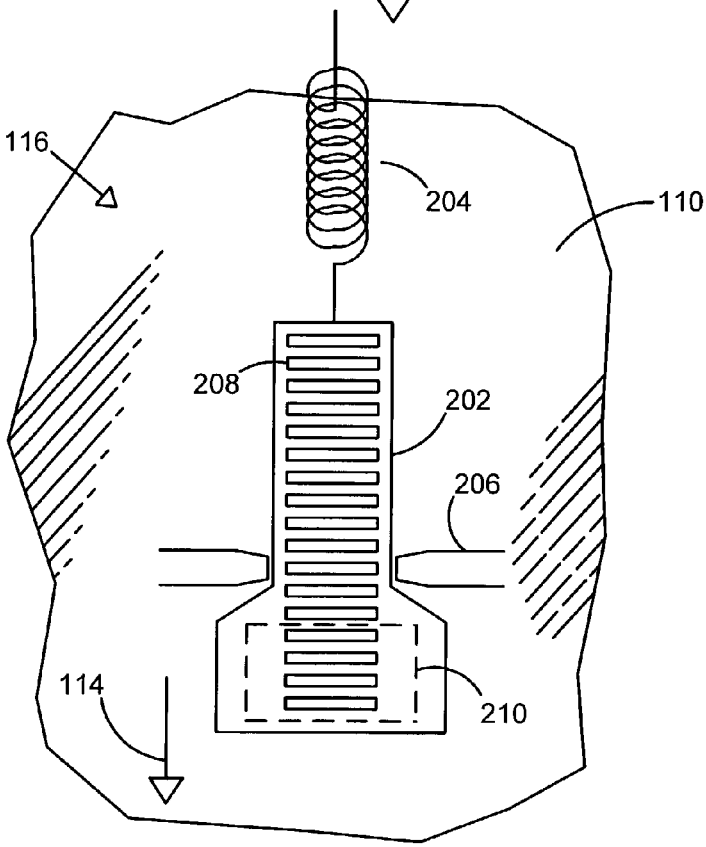
FIG. 2 is an enlarged plan view of the implementation of the reciprocating linear encoder of FIG. 1, showing additional detail.

FIG. 2 shows an enlarged view of a portion of the exemplary implementation of the reciprocating linear encoder 116. A linear encoder 202 portion of the reciprocating linear encoder 116 is seen in a docking position above print media 110, such as paper or an envelope. A tensioning element 204 provides back tension, i.e. bias or force in the direction opposite print media flow 114. The tensioning element 204 may take the form of a coil spring (as illustrated), bow spring, magnet, elastic filament or other element. Left and right locator stops 206, together with the tensioning element 204, are useful in holding the linear encoder 202 within the docking position illustrated.

Indicia 208, such as bars, stripes, magnetic patterns or other indicators, are defined on a first surface of the linear encoder 202. As will be seen in greater detail below, movement of the linear encoder 202 is detected by sensing movement of the indicia 208.

A frictional surface 210 is present on a second side (opposite the indicia) of the linear encoder 202. As will be seen in greater detail, the frictional surface 210 is suited to engage media traveling through the paper path 112. Due to the frictional contact between the frictional surface 210 and the media 110, the media 110 will move the linear encoder 202 as the media is driven by the advancement mechanism 108.

Figure 3:
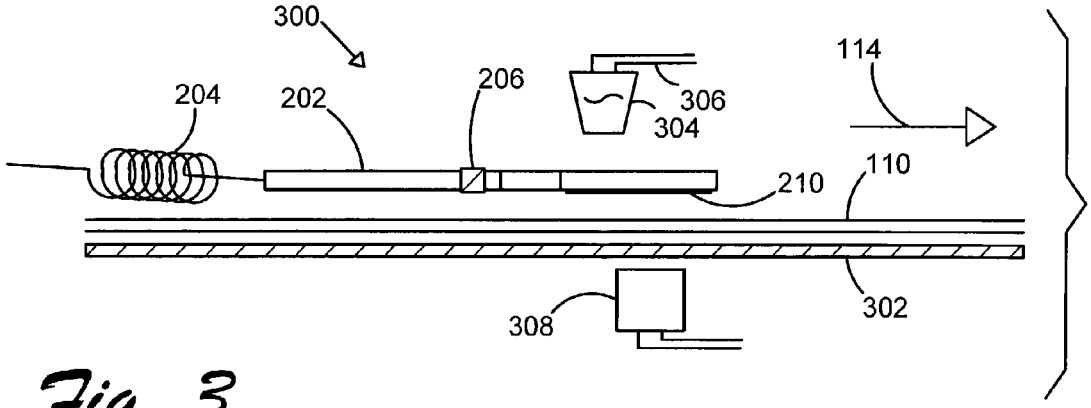
FIG. 3 is a cross-sectional view of the implementation of FIG. 1, taken along the 3—3 lines, wherein an implementation of a linear encoder is in a parked position, above print media.

FIG. 3 is a cross-sectional view of the exemplary reciprocating linear encoder 116 of FIG. 1, wherein a linear encoder 202 is in a parked position 300, above print media 110. The frictional surface 210 is separated from the print media by sufficient distance to prevent contact. The print media slides on a deck 302, which in part defines the paper path. The tensioning element 204 retains the linear encoder against the locator stops 206.

A sensor 304 portion of the linear encoder 116 is wired 306 to the registration decoder electronics 118, and is configured to monitor the movement of indicia 208 defined on the first surface of the linear encoder 202.

Figure 4:
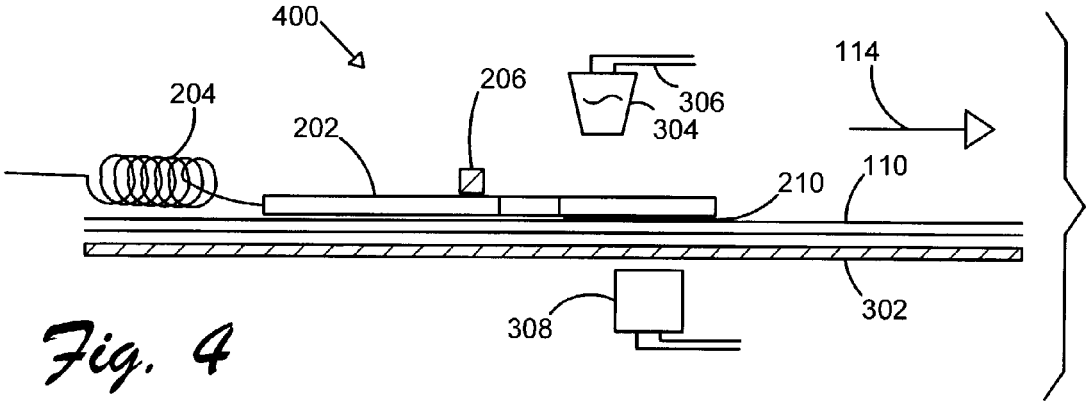
FIG. 4 is a cross-sectional view similar to that of FIG. 3, wherein the implementation of the linear encoder has moved into a latched position, biased against the print media.

A biasing element 308, such as an electromagnet, is located in a position whereby activation causes the linear encoder 202 to move to the latched position 400, seen in FIG. 4.

FIG. 4 is a cross-sectional view taken from a perspective similar to that of FIG. 3, wherein a linear encoder 202 has moved into a latched position 400. In the latched position, the frictional surface 210 of the linear encoder 202 is engaged in a static frictional connection to the print media 110. The linear encoder 202 is therefore no longer in contact with the locator stops 206. The static friction is encouraged by the biasing element 308, which tends to hold the linear encoder 202 against the print media 110.

Figure 5:
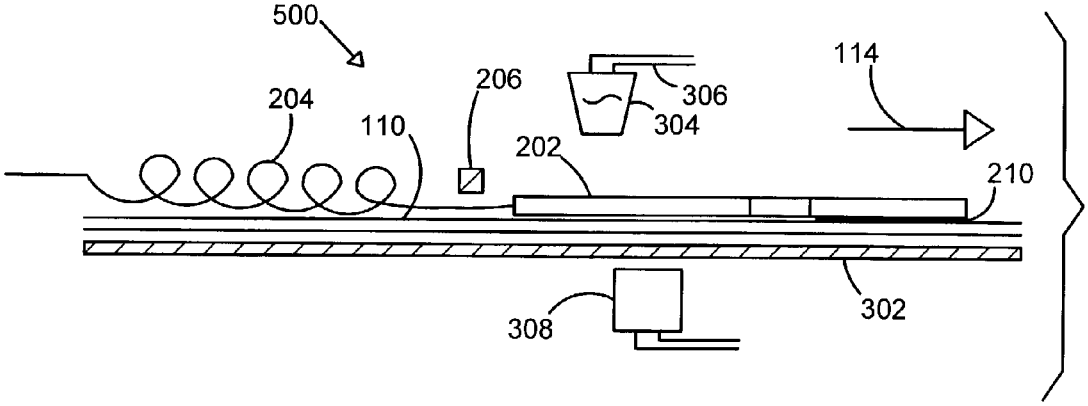
FIG. 5 is a cross-sectional view similar to that of FIG. 3, wherein the implementation of the linear encoder is in a tracking position, moving in concert with print media.

FIG. 5 is a cross-sectional view taken from a perspective similar to that of FIGS. 3 and 4, wherein a linear encoder 202 has moved into a tracking position 500. The tensioning element 204, depicted for purposes of illustration as a coil spring, becomes elongated as the linear encoder 202 moves with the print media 110. A preferred tensioning element 204 applies near constant force, and may be selected partly on this basis. The tracking position 500 is configured to allow the frictional bond between the linear encoder 202 and the print media 110 to move the linear encoder 202 with the print media 110 as the print media advancement mechanism 108 drives the print media 110 through the print path 112. Thus, the linear encoder 202 is substantially fixed with respect to the print media, but does move with respect to the printer 102. Accordingly, the sensor 304 can detect movement of the print media with an accuracy of greater than 100 ppm by viewing indicia 208 on the linear encoder 202.

In a typical application, the print media is advanced approximately 1" to 2" in periodic intervals. Between advancements, the printhead 104 applies ink to the print media. The registration decoder electronics 118 is configured to release the biasing element 308, after advancement of the print media 110 is completed, thereby allowing the tensioning element 204 to return the linear encoder 202 to the latched position 300 seen in FIG. 3.

When viewed in series, FIGS. 3, 4 and 5 disclose a cyclical or reciprocating pattern, whereby the linear encoder 202 is configured to latch, follow and release print media in a periodic motion. The parked position 300 is succeeded by a latched position 400, wherein the linear encoder 202 is moved into contact with the print media 110 by the biasing element. The latched position 400 is succeeded by a tracking position 500, wherein the linear encoder 202 follows the print media 110, allowing for a sensor to gather information sufficient to determine print media registration (i.e. linefeed registration). When released by the biasing element 308, the linear encoder 202 is able to return to the parked position under the influence of the tensioning element 204. This cycle may be repeated each time print media 110 is advanced.

Figure 6:
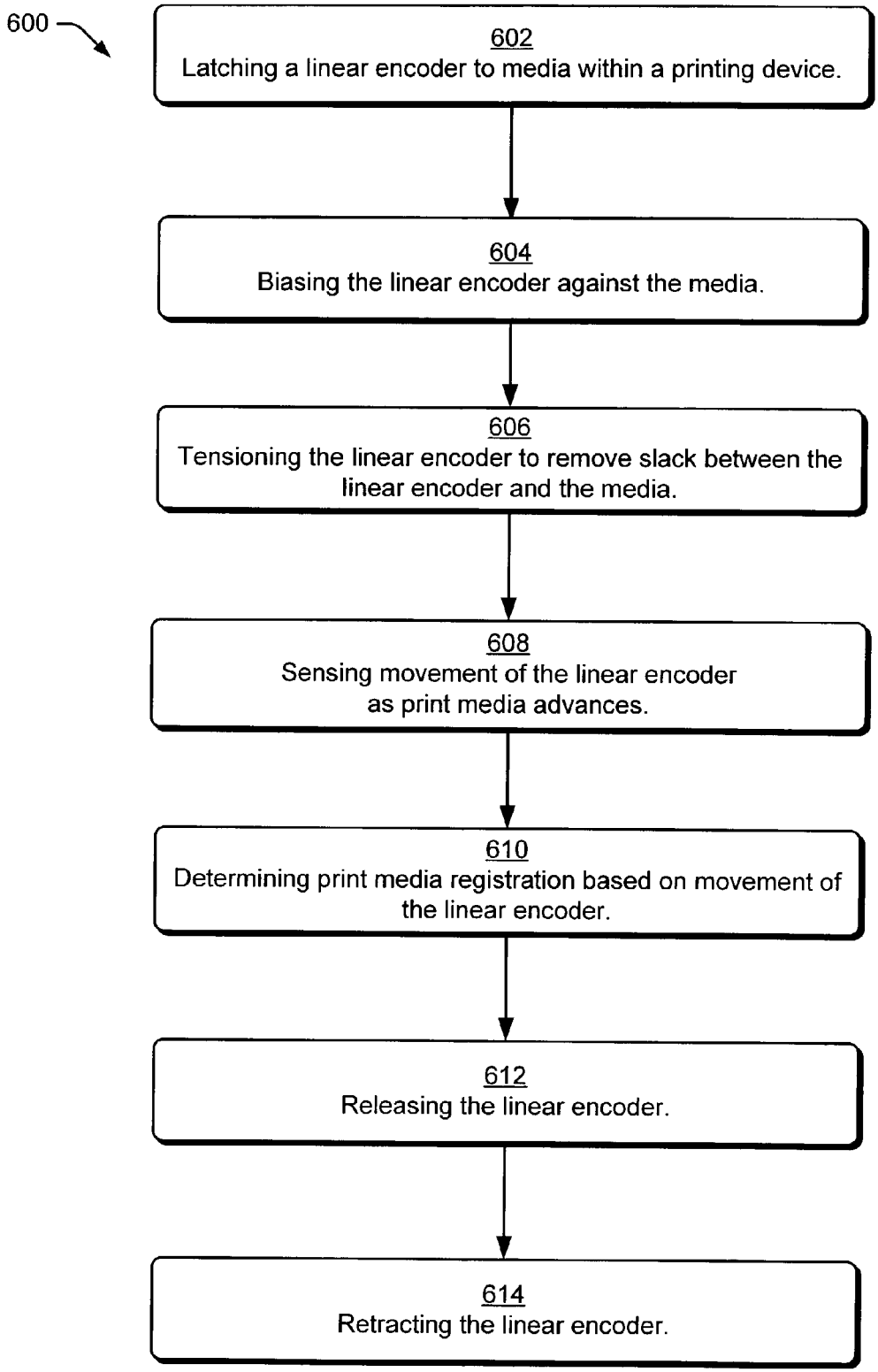
FIG. 6 is a flow diagram that describes an exemplary implementation, including a method employed for use in determining print media registration.

The flow chart of FIG. 6 illustrates a further exemplary implementation, wherein a method 600 is employed for determining print media registration. The elements of the method may be performed by any desired means, such as by the movement of mechanical parts initiated and controlled through the execution of processor-readable instructions defined on a processor-readable media, such as a disk, a ROM or other memory device. Also, actions described in any block may be performed in parallel with actions described in other blocks, may occur in an alternate order, or may be distributed in a manner which associates actions with more than one other block.

At block 602, a linear encoder 202 is latched to media 110 within a printing device 102. The latching process may be initiated by activation of a biasing element 308, such as an electromagnet. The biasing element 308 causes the linear encoder to move from the parked position 300, seen in FIG. 2, to the latched position 400, seen in FIG. 4.

At block 604, the linear encoder 202 is biased against the media 110, typically by continued force exerted on the linear encoder 202 by the biasing element 308. The bias provided in this manner increases the coefficient of friction between the frictional surface 210 and the media 110.

At block 606, the linear encoder 202 is tensioned to substantially remove slack between the linear encoder 202 and the media 110. The tensioning force is provided by the tensioning element 204, which slides the linear encoder 202 against the print media 110 until a secure static frictional bond results.

At block 608, movement of the linear encoder 202 is sensed. In the tracking position 500, movement of the print media 110 causes movement of the linear encoder 202. Accordingly, movement of the indicia 208 on the linear encoder 202 is sensed by the sensor 304.

At block 610, print media registration is determined based on movement of the linear encoder 202, and a resulting signal created by the sensor 304, which is processed by the registration decoder electronics 118.

At block 612, the linear encoder 202 released by the biasing element 308. In the implementation of FIGS. 3–5, when the registration decoder electronics 118 turns off power to the biasing element 308, the friction between the frictional surface 210 and the print media 110 is greatly reduced.

At block 614, the linear encoder 202 is retracted by the tensioning element 204. Due to the greatly reduced friction between the linear encoder 202 and the print media 110 tensioning element 204 is able to move the linear encoder 202 from the tracking position 500, seen in FIG. 5, to the parked position 300, seen in FIG. 3.

Figure 7:
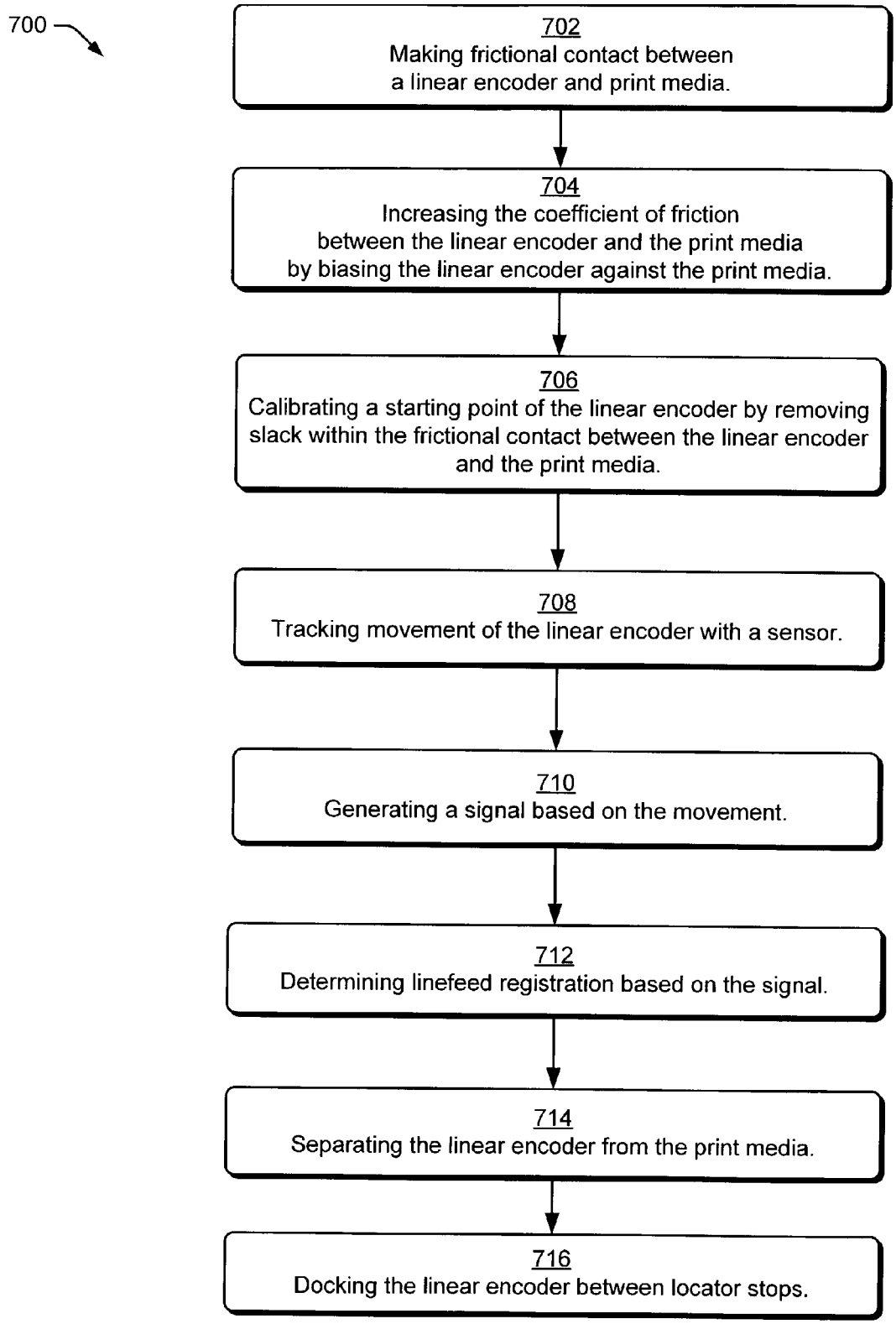
FIG. 7 is a flow diagram that describes an exemplary implementation, including a method employed to measure linefeed registration in a printing device.

The flow chart of FIG. 7 illustrates a further exemplary implementation, wherein a method 700 is employed to measure linefeed registration in a printing device. The elements of the method may be performed by any desired means, such as by the movement of mechanical parts initiated and controlled through the execution of processor-readable instructions defined on a processor-readable media, such as a disk, a ROM or other memory device. Also, actions described in any block may be performed in parallel with actions described in other blocks, may occur in an alternate order, or may be distributed in a manner which associates actions with more than one other block.

At block 702, a linear encoder 202 is bonded to print media 110. The bonding process may be performed by moving the linear encoder from the parked or docked position 300 of FIG. 3, to the latched position 400, seen in FIG. 4, wherein a frictional connection is made between the frictional surface 210 of the linear encoder 202 and the print media 110.

At block 704, the coefficient of static friction, between the linear encoder 202 and the media 110, is increased by biasing the linear encoder 202 against the media 110. The biasing is performed by a biasing element 308, which may include an electromagnet, spring or similar device.

At block 706, a starting point of the linear encoder is calibrated by removing slack within the frictional contact between the linear encoder 202 and the media 110. Some "slack" may initially be present within the frictional bond between the linear encoder 202 and the print media 110. Slack includes any relative motion between encoder marks 208 as seen by sensor 304 and media 110 in the area of contact with frictional surface 210. The slack is substantially removed by the tensioning element 204, thereby allowing the linear encoder 202 to move in concert with the print media 110.

At block 708, movement of the linear encoder 202 is tracked by a sensor 304, which observes the indicia 208 defined on the linear encoder 202.

At block 710, a signal is generated by the sensor, based on the movement of the linear encoder 202.

At block 712, linefeed registration is determined based the signal, typically by the registration decoder electronics 118.

At block 714, the linear encoder 202 is separated from the media by releasing forces created by the biasing element 308. Due to the reduction in the coefficient of static friction when the biasing element releases, the tensioning element 204 is able to break the frictional bond between the linear encoder 202 and the print media 110.

Note that while a single tensioning element 204 is drawn, a compound tensioning element (such as two springs) may be used. The tensioning element, single or compound, should be selected to result in movement of the linear encoder over a desired course, such between the positions 500 and 300, seen in FIGS. 5 and 3, respectively.

At block 716, the linear encoder 202 is docked between locator stops 206, in the parked position 300 seen in FIG. 3. In one embodiment, the tensioning element 204 moves the linear encoder from the tracking position 500 of FIG. 5, into the parked position 300 of FIG. 3. Accordingly, the linear encoder 202 moves in a periodic manner, from the parked position 300, to the latched position 400, to the tracking position 500 and then back to the parked position 300.

Figure 8:
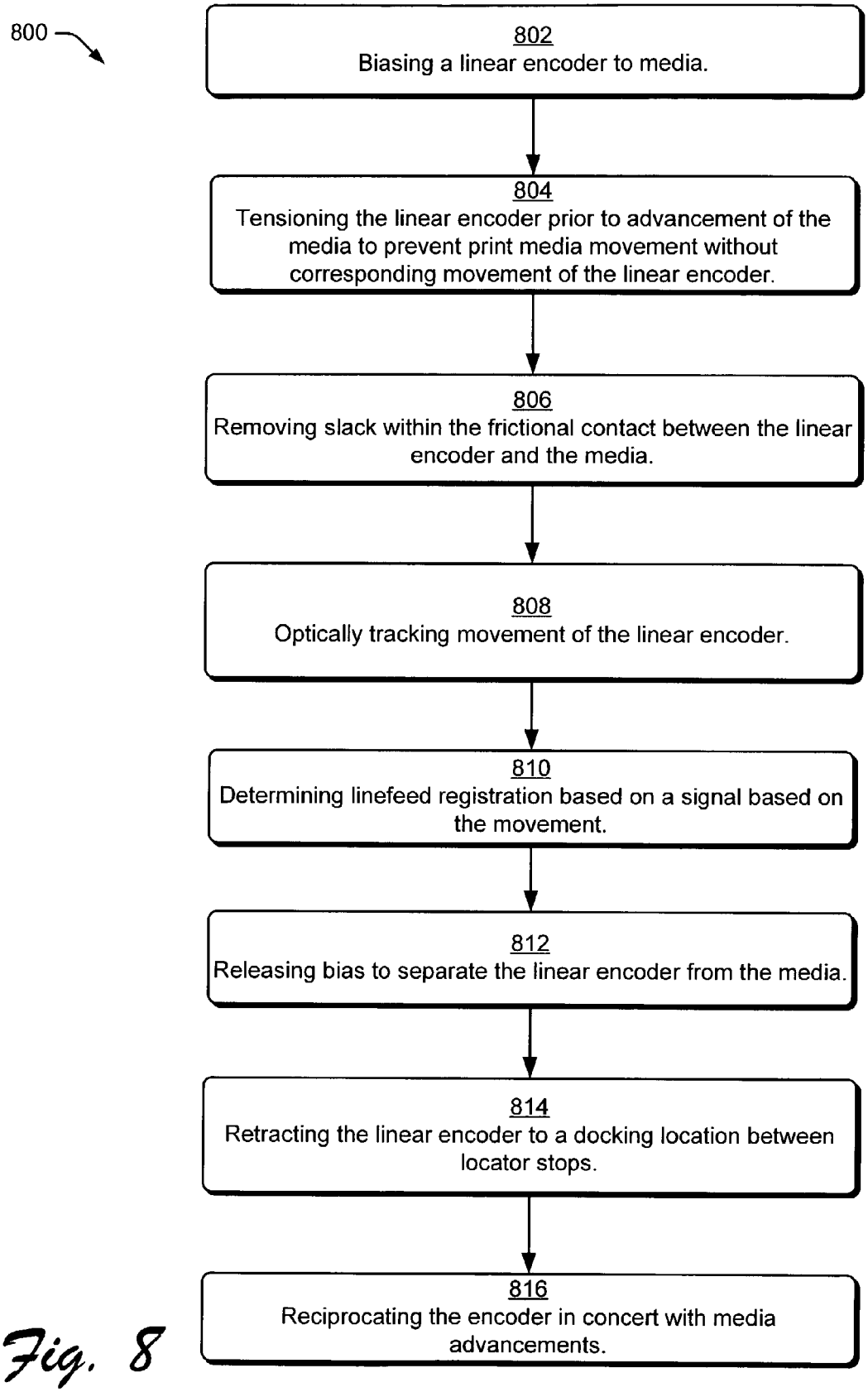
FIG. 8 is a flow diagram that describes an exemplary implantation, including a method a method employed to determine print media registration.

The flow chart of FIG. 8 illustrates a further exemplary implementation, wherein a method 800 is employed to determine print media registration. The elements of the method may be performed by any desired means, such as by the movement of mechanical parts initiated and controlled through the execution of processor-readable instructions defined on a processor-readable media, such as a disk, a ROM or other memory device. Also, actions described in any block may be performed in parallel with actions described in other blocks, may occur in an alternate order, or may be distributed in a manner which associates actions with more than one other block.

At block 802, a linear encoder 202 is biased to media 110. The linear encoder 202 may be biased by a biasing element 308 such as an electromagnet, which increases the coefficient of static friction between the media 110 and a frictional surface 210 on the linear encoder 202.

At block 804, the linear encoder 202 is tensioned prior to advancement of the print media 110. The tension applied to the linear encoder 202, such as by a tensioning element 204, substantially prevents print media movement without corresponding movement of the linear encoder 202.

At block 806, slack is substantially removed within the frictional contact between the linear encoder 202 and the media 110. Accordingly, in response to force initiated by the tensioning element 204, the linear encoder 202 is retracted until the coefficient of static friction is sufficiently strong to prevent further retraction. At this point, the slack is fully removed, and the bond between the linear encoder 202 and the print media 110 is strong enough to prevent kinetic friction when the print media 110 advances.

At block 808, movement of the linear encoder 202 is tracked optically by a sensor 304, responsive to the indicia 208 defined on the linear encoder 202.

At block 810, linefeed registration is determined based on a signal based on the movement of the linear encoder 202. The registration decoder electronics 118 is configured to receive the signal and determine registration.

At block 812, bias is released, thereby allowing the linear encoder 202 to separate from the media 110. When the bias of the biasing element 308 is released, the coefficient of static friction binding the linear encoder 202 to the print media 110 is decreased sufficiently to allow the tensioning element 204 to overcome the friction and cause separation.

At block 814, the linear encoder 202 is retracted to a parked (docked) position (location) 300, wherein the linear encoder 202 is positioned between locator stops 206. The agent causing the retraction can be a tensioning element 204 or similar device.

At block 816, the linear encoder 202 is reciprocated in concert with print media advancements. Accordingly, the linear encoder 202 reciprocates through a cycle—including a parked position 300, a latched position 400 and a tracking position 500—each time the print media is advanced. Movement from the tracking position 500 to the parked position 300 is typically performed during the printing process, as the printhead 104 moves across the print media 110.

Although the disclosure has been described in language specific to structural features and/or methodological steps, it is to be understood that the appended claims are not limited to the specific features or steps described. Rather, the specific features and steps are exemplary forms of implementing this disclosure. For example, while a number of embodiments have been disclosed, some variation could be made while still in keeping within the teachings of this document.

Additionally, while one or more methods have been disclosed by means of flow charts and text associated with the blocks, it is to be understood that the blocks do not necessarily have to be performed in the order in which they were presented, and that an alternative order may result in similar advantages.

What is claimed is:

1. A reciprocating linear encoder, comprising:

a linear encoder to latch, follow and release print media in a periodic motion; and a sensor, responsive to movement of the linear encoder, to output a signal associated with print media movement.

2. The reciprocating linear encoder of claim 1, additionally comprising:

a frictional surface, carried by the linear encoder, to frictionally engage print media.

3. The reciprocating linear encoder of claim 2, additionally comprising:

a biasing element, to bias the frictional surface against the print media.

4. The reciprocating linear encoder of claim 3, wherein the biasing element comprises an electromagnet.

5. The reciprocating linear encoder of claim 1, additionally comprising:

indicia, defined on the linear encoder, to be detectable by the sensor.

6. The reciprocating linear encoder of claim 1, additionally comprising:

a tensioning element, attached to the linear encoder, to provide back tension.

7. A printer, comprising:

a print media advancement mechanism;

a linear encoder having a frictional surface to attach and release print media; and a sensor, reactive to movement of the linear encoder, to output a signal descriptive of print media movement.

8. The printer of claim 7, additionally comprising:

a biasing element to periodically apply bias to the frictional surface, promoting friction between the frictional surface and the print media.

9. The printer of claim 8, wherein the biasing element comprises an electromagnet.

10. The printer of claim 7, additionally comprising:

indicia, defined on the linear encoder for recognition by the sensor.

11. The printer of claim 7, additionally comprising:

a tensioning element to substantially remove slack between the linear encoder and the print media.

12. A processor-readable medium comprising processor-executable instructions for determining print media registration, the processor-executable instructions comprising instructions for:

latching a linear encoder to print media within a printing device;

sensing movement of the linear encoder; and determining print media registration based on movement of the linear encoder.

13. A processor-readable medium as recited in claim 12, wherein latching comprises instructions for:

biasing the linear encoder against the print media; and tensioning the linear encoder to substantially remove slack between the linear encoder and the print media.

14. A processor-readable medium as recited in claim 12, additionally comprising instructions for:

releasing the linear encoder; and retracting the linear encoder.

15. A method of measuring linefeed registration in a printing device, comprising:

clamping a frictional surface of a linear encoder to print media;

tracking movement of indicia defined on the linear encoder; and generating a signal based on the movement of the linear encoder.

16. The method of claim 15, additionally comprising:

determining print media registration based the signal.

17. The method of claim 15, additionally comprising:

calibrating a starting point of the linear encoder by substantially removing slack within the frictional contact between the linear encoder and the print media.

18. The method of claim 15, additionally comprising:

separating the linear encoder from the print media; and docking the linear encoder between locator stops.

19. A linefeed registration apparatus, comprising:

means for bonding a linear encoder to print media;

means for tracking movement of the linear encoder;

means for generating a signal based on the movement; and means for determining linefeed registration based the signal.

20. The linefeed registration apparatus of claim 19, additionally comprising:

means for increasing frictional coefficient between the linear encoder and the print media by biasing the linear encoder against the print media.

21. The linefeed registration apparatus of claim 19, additionally comprising:

means for calibrating a starting point of the linear encoder by substantially removing slack from frictional contact between the linear encoder and the print media.

22. The linefeed registration apparatus of claim 19, additionally comprising:

means for separating the linear encoder from the print media; and means for docking the linear encoder between locator stops.

23. A processor-readable medium comprising processor-executable instructions for:

biasing a linear encoder to media;

optically tracking movement of the linear encoder;

determining linefeed registration based on a signal based on the movement; and reciprocating the linear encoder in concert with media advancements.

24. The processor-readable medium of claim 23, comprising additional instructions for:

tensioning the linear encoder prior to advancement of the media to substantially prevent media movement without corresponding movement of the linear encoder.

25. The processor-readable medium of claim 23, comprising additional instructions for:

substantially removing slack within frictional contact between the linear encoder and the media.

26. The processor-readable medium of claim 23, comprising additional instructions for:

releasing bias to separate the linear encoder from the media; and retracting the linear encoder to a docking location between locator stops.

27. A print media registration apparatus, comprising:

a linear encoder, configured to latch, follow and release print media in a periodic motion;

a frictional surface, carried by the linear encoder, configured to frictionally engage the print media;

a biasing element, configured to bias the frictional surface against the print media;

a tensioning element, attached to the linear encoder, to provide back tension;

locator stops to support the linear encoder in a docking position;

a sensor, configured to optically track movement of the linear encoder, and to produce a signal associated with print media movement;

indicia, defined on the linear encoder, configured for detection by the sensor; and registration decoder electronics to process the signal.

28. A method of measuring linefeed registration in a printing device, comprising:

parking a linear encoder adjacent to print media;

latching the linear encoder to the print media;

tracking movement of the linear encoder as the print media advances; and determining linefeed registration based on the movement of the linear encoder.

* * * * *